US007465139B2

(12) United States Patent
Diem et al.

(10) Patent No.: US 7,465,139 B2
(45) Date of Patent: Dec. 16, 2008

(54) SAFETY DEVICE IN THE SHEET FEEDER

(75) Inventors: Guntram Diem, Vienna (AT); Norbert Sommer, Vienna (AT); Mirko Link, Riesa (DE)

(73) Assignee: Koenig & Bauer AG, Radebeul (DE)

( * ) Notice: Subject to any disclaimer, the term of this patent is extended or adjusted under 35 U.S.C. 154(b) by 151 days.

(21) Appl. No.: 11/411,187

(22) Filed: Apr. 25, 2006

(65) Prior Publication Data

US 2006/0244201 A1 Nov. 2, 2006

(30) Foreign Application Priority Data

Apr. 27, 2005 (DE) ..... 10 2005 019 537
Apr. 27, 2005 (DE) ..... 10 2005 019 538

(51) Int. Cl.
*B65G 69/00* (2006.01)

(52) U.S. Cl. ..... 414/21; 271/10.01; 271/157; 400/624; 400/646; 400/647; 400/718; 340/666

(58) Field of Classification Search ..... 271/10.01, 271/145, 157; 400/624, 646, 647, 718; 414/21; 340/666

See application file for complete search history.

(56) References Cited

U.S. PATENT DOCUMENTS 4,033,578 A * 7/1977 Taylor et al. ..... 271/157
4,455,115 A * 6/1984 Alger et al. ..... 414/21
4,971,515 A * 11/1990 Pol et al. ..... 414/797
5,123,637 A * 6/1992 Musaka ..... 271/117
5,215,299 A * 6/1993 Luft ..... 271/160
5,497,984 A * 3/1996 Murakami et al. ..... 270/58.02
RE37,062 E * 2/2001 Walker ..... 414/809

FOREIGN PATENT DOCUMENTS

DE 10 2004 002 307 A 8/2004
DE 203 12 459 U1 12/2004
DE 198 55 191 A1 6/2006

* cited by examiner

*Primary Examiner*—Patrick H Mackey
*Assistant Examiner*—Prasad V Gokhale
(74) *Attorney, Agent, or Firm*—Goodwin Procter, LLP

(57) ABSTRACT

A safety device with two conveying systems in the sheet feeder of a machine, capable of processing a sheet-shaped material. An objective of the invention is to construct a generic sheet feeder for large-format machines so that only stacks with a specified maximum weight can reach the processing stage. The present invention encompasses a weighing device (22, 28) located in the sheet feeder (1), which determines the weight of the stack (4), is positioned on the stack carrier (3) and is connected with a regulating and controlling device (19) controlling the driving mechanism (8). At least one permissible total weight is stored in the regulating and controlling device (19). The regulating and controlling device (19) compares the weight of the stack with said stored permissible total weight and the driving mechanism (8) is activated only if the weight of the stack does not exceed the permissible total weight.

15 Claims, 3 Drawing Sheets

SAFETY DEVICE IN THE SHEET FEEDER

FIELD OF THE INVENTION

The invention relates to a safety device in the sheet feeder of a machine, which processes sheet-shaped material. The sheet feeder has a conveying system connected to a driving mechanism for (a) lifting a stack carrier after the latter has taken a stack, consisting of the sheet-shaped material, from a stack-acquiring position; and (b) lowering a stack carrier after the transfer of the stack to an auxiliary stack carrier or after the singulating and discharging of the sheet-shaped material by a separating and conveying device.

BACKGROUND OF THE INVENTION

DE 10 2004 002 307 A1 discloses machines capable of processing sheet-shaped material, whereby the material is delivered in stacks, singulated in sheet feeders and transported to the next machine downstream in the process. For this purpose, a main stack is positioned on a main stack carrier in a stack-acquiring position. A conveying system, preferably in the form of lifting chains, is connected with a driving mechanism and engages the main stack carrier. The sheet-shaped material is singulated from the top of the main stack by the separating and conveying device and transported to the next machine downstream. At the same time, the main stack carrier is raised periodically or continuously. Once the main stack is singulated, the main stack carrier is returned to its starting position at or directly above floor level, in preparation to take a new stack.

In order to facilitate a continuous operation, it is customary to provide an auxiliary stack carrier, which conveys an auxiliary stack of sheets periodically or continuously to the separating and conveying device. While the auxiliary stack carrier is conveying the auxiliary stacks, the main stack carrier is brought back to its starting position for taking of a subsequent stack of sheets. After the main stack carrier has taken the subsequent stack of sheets, the main stack carrier is raised by the conveying system and the subsequent stack of sheets is combined with the auxiliary stack conveyed by the auxiliary stack carrier and the assembled stack is taken to the separating and conveying device.

For sheet feeders of a smaller format, the maximum weight of the stack is limited by the area available on the stack carrier and limited in height by the position of the separating and conveying device. The conveying system, its driving mechanism and the statics of the sheet feeder frame are designed from the aspect of the desired maximum stack weight. Similarly, large format sheet feeders are characterized by the large area available on the stack carrier, the large distance between the separating mechanism and conveying mechanism and floor level, and the wide spectrum of materials which may be processed on such machines. However, because of worker safety considerations, it is necessary to start out from the largest possible stack weight when designing the conveying system, the driving mechanism and the static for large format sheet feeders. Because the maximum stack weight must be taken into consideration and because the feeders must incorporate necessary safety features, the related safety components of the feeder are overdimensioned resulting in high manufacturing costs. In view of the fact that stacks with the maximum conceivable weight are processed only in isolated cases, such a sheet feeder design is not economically practical.

SUMMARY OF THE INVENTION

It is an objective of the invention to develop a generic sheet feeder for large format machines, so that only stacks of a specified, maximum weight can reach the processing stage.

The present invention accomplishes this objective with a safety device having the distinguishing features outlined in claim 1.

The present invention provides a low cost design for the safety-related components of the sheet feeder, especially of large format machines. Overloading of these components is precluded by the safety device, and the requirements of safety and worker protection laws are satisfied.

BRIEF DESCRIPTION OF THE DRAWINGS

Preferred embodiments of the present invention are represented in the drawings and will be described in greater detail in what follows.

DETAILED DESCRIPTION OF THE INVENTION

Figure 1:
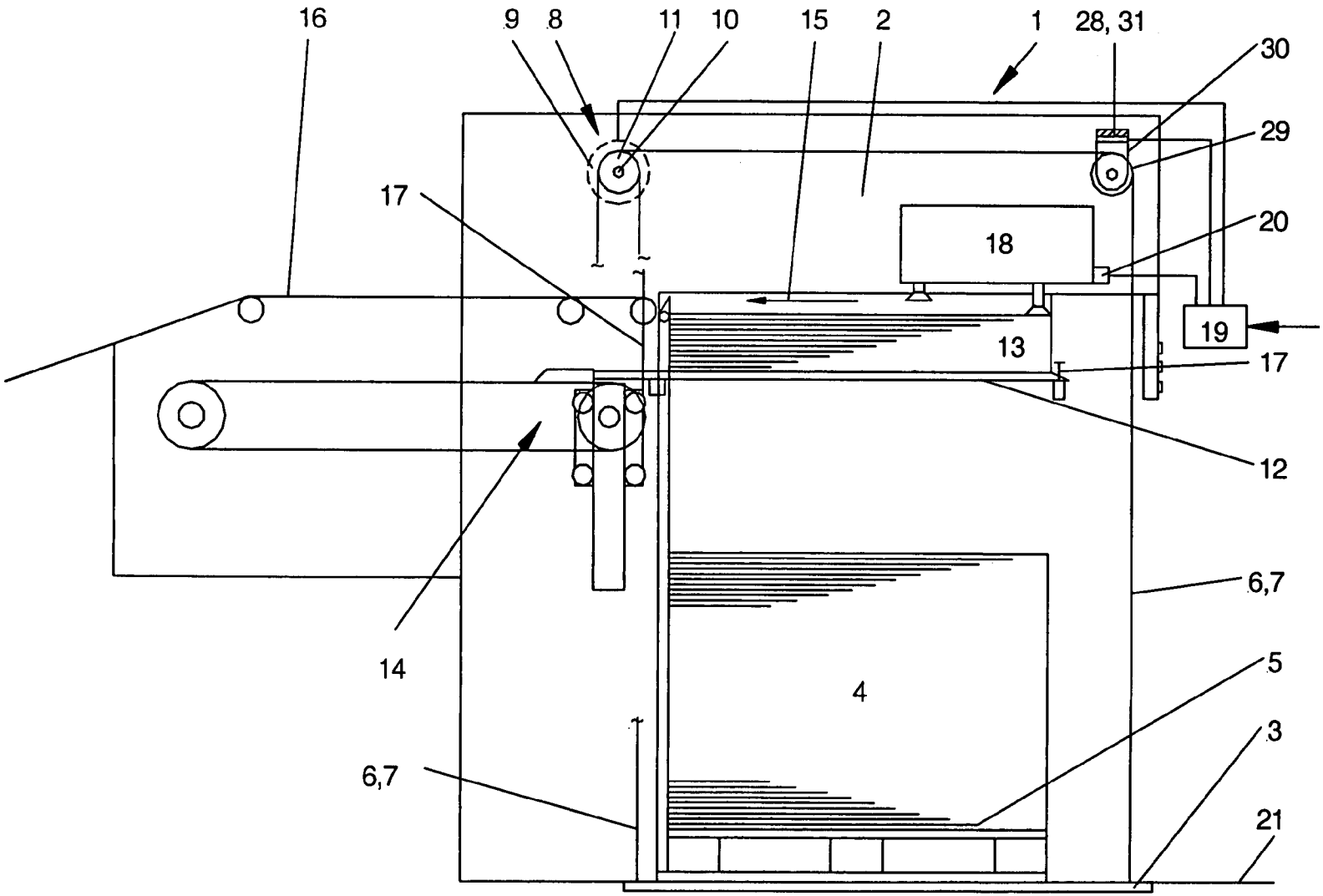
FIG. 1, is a schematic representation of a sheet processing machine with a sheet feeder from the side view.

A sheet feeder (1) with a frame (2) and a main stack carrier (3) is shown in FIG. 1. A stack (4), which consists of sheet-shaped material (5), is located on the main stack carrier (3). A conveying system (6) preferably contains tension elements (7), each of which engages a corner of the main stack carrier (3). The tension elements (7) of the conveying system (6) are connected to a driving mechanism (8). The driving mechanism (8) consists of, preferably, a motor (9) which drives a drive shaft (10), to which four driving wheels (11) are connected non-rotationally. Each driving wheel (11) is in operative connection with one tension element (7).

In a preferred embodiment, an auxiliary stack carrier (12), which carries a auxiliary stack (13), is provided next to the main stack carrier (3). The auxiliary stack carrier (12) may be conveyed by a transporting device (14) in a direction counter to a conveying direction (15) into the stack room, or in the conveying direction (15) out of the stack room under a tape table (16), which is positioned downstream from the sheet feeder (1). An auxiliary conveying system (17), which is connected to an auxiliary driving mechanism that is not shown and guides the auxiliary stack carrier (12), so that the top side of the auxiliary stack (13) is held constantly in operative connection with the separating and conveying device (18), is associated with the auxiliary stack carrier (12). For this purpose, measuring device (20), which detects the position of the top side and is connected to a controlling and regulating device (19) controlling the sheet feeder (1), is provided in the sheet feeder (1).

If the intention is to operate the sheet feeder (1) without an auxiliary stack carrier (12), the position of the top side of the stack (4) is detected and the motor (9) of the driving mechanism (8) is controlled by the controlling and regulating device (19). In a lower position, in which the stack (4) is positioned on the main stack carrier (3), the surface of the main stack carrier (3) forms a plane with floor level (21). At the same time, the back of the main stack carrier (3) is resting on a first weighing device (22). The first weighing device (22) consists of a stationary lower frame (23) and an upper frame (24) (FIG. 2), wherein the upper frame (24) can be shifted in a vertical direction and is associate with the lower frame (23). The upper frame (24) overlaps the lower frame (23), forming a sliding seat (25) and is supported by four stops (26) against rigid struts (28) of the lower frame. The stops (26) may be constructed as measured value transducers (27) and are connected with the regulating and controlling device (19).

In a preferred embodiment, only two stops (26) are constructed as measured value transducers (27). The measured value transducers (27) are positioned on a diagonal in the lower frame (23). This embodiment provides a cost-effective solution.

When the sheet feeder (1) is being operated, the main stack carrier (3) is brought into a position for taking a stack (4). In this position, the surface of the main stack carrier (3) forms a plane with floor level (21). At the same time, the underside of the main stack carrier (3) is seated on the upper frame (24) of the first weighing device (22). After that, a stack (4) can be positioned on the main stack carrier (3). If four stops (26) are constructed as measured value transducers (27), a measured value is generated by each measured value transducer (27) and supplied to the controlling and regulating device (19). The sum of the four measured values reflects the weight of the stack (4), provided that the weight of the stack carrier (3) was not taken into consideration when the first weighing device (22) was calibrated.

Figure 2:
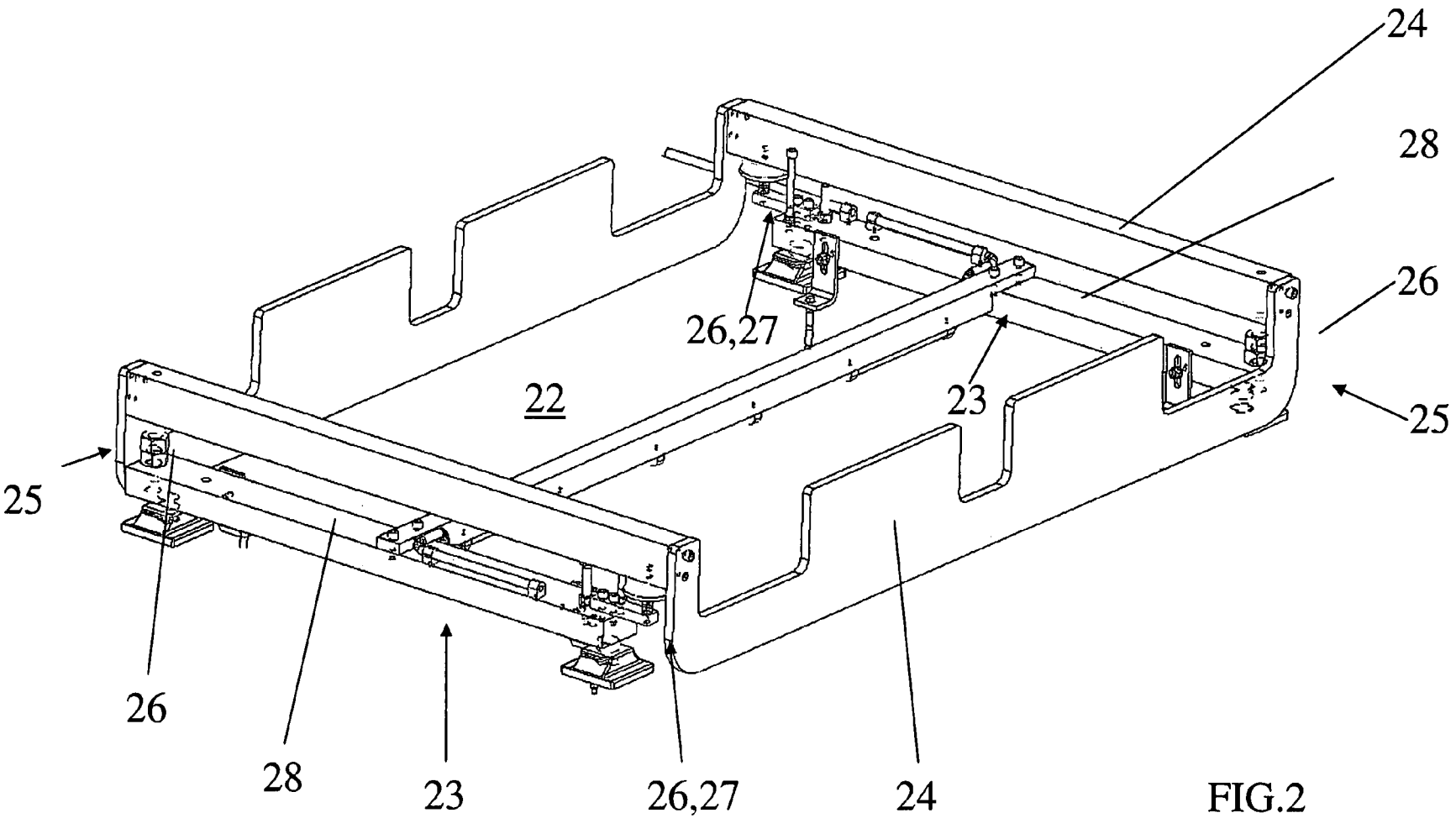
FIG. 2, is a schematic representation of a weighing device
Figure 3:
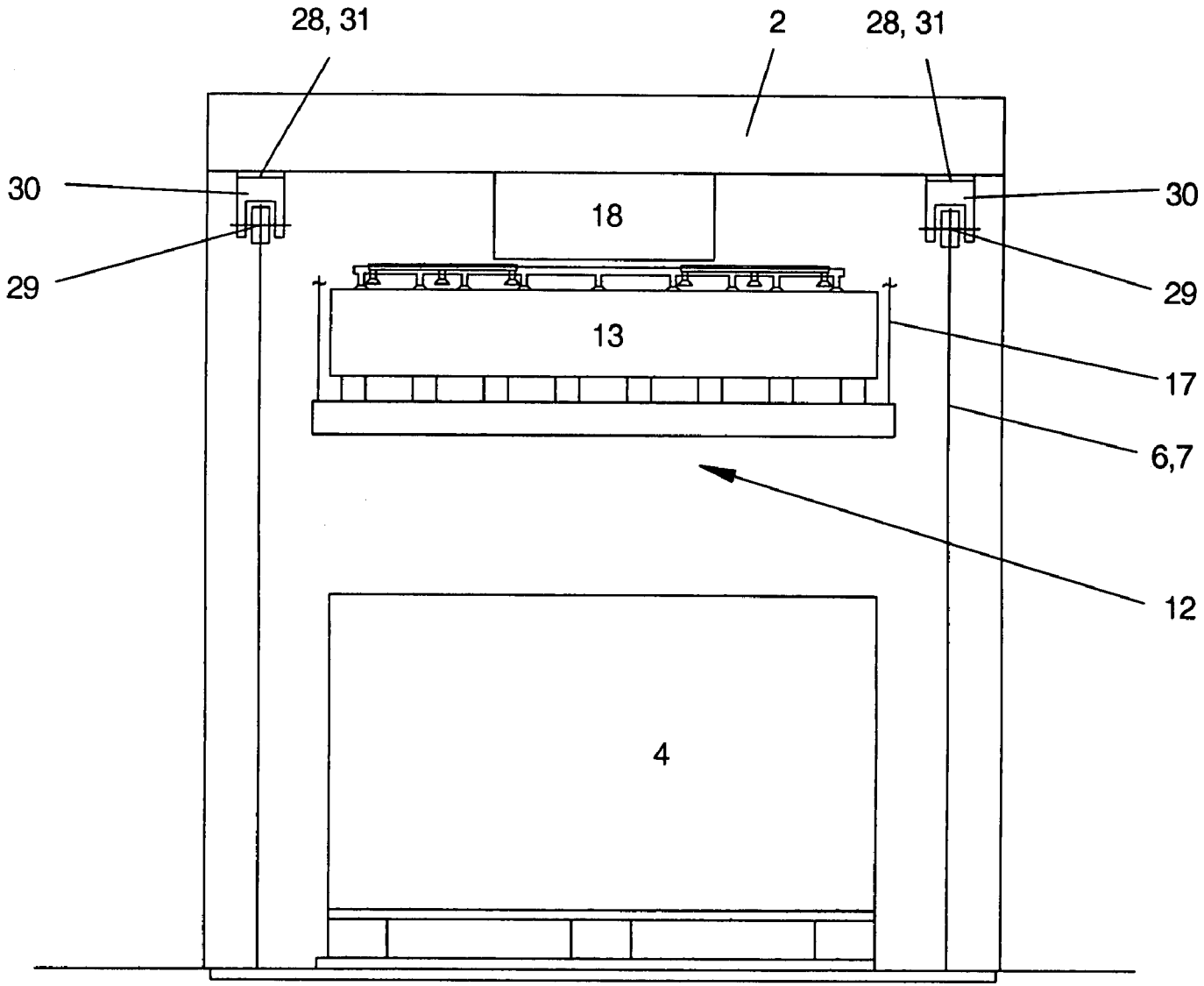
FIG. 3, is a schematic representation of the sheet feeder of FIG. 1 as seen from the rear.

If only two measured value transducers (27) are provided, as shown in FIG. 2, only half the weight of the stack (4) is detected by the measured values generated and the actual stack weight is determined in the regulating and controlling device (19). Assuming that only stacks (4) of sheet-shaped material (5) are supplied, the dimensions of which are within the range prescribed for the sheet-processing machine, and the stacks (4) are positioned centrally on the main stack carrier (3), the center of gravity of the stack (4) is always within a small region, so that the measurement errors occurring remain within a range which can be tolerated.

It is also possible to provide only one measured value transducer (27) and to position the transducer in the center of gravity region of the stack (4) that is to be processed. The regulating and controlling device (19) will compensate for the errors that occur depending on the format that is to be processed.

The transducer (27) generate measured values from the actual weight of the main stack (4), positioned on the main stack carrier (3), and supplies the values to the regulating and controlling device (19). The weight of the stack is compared with a permissible total weight stored in the regulating and controlling device (19). If the weight of the stack is below the permissible total weight, the motor (9) of the driving mechanism (8) is activated by the regulating and controlling device (19) and the main stack carrier (3), with the main stack (4), is raised in rapid traverse by means of the conveying system (6).

If the sheet feeder (1) is operated without the auxiliary stack carrier (12), there is a switching over of the driving mechanism (8) to a creeping speed after the top side of the stack (4) approaches the separating and conveying device (18). The stack (4) is fed to the separating and conveying device (18) so that the sheet-shaped material (5) can be separated and discharged. After the stack (4) is finished, the main stack carrier (3) is brought into its stack-accepting position, in which the top side of the main stack carrier (3) is level with the floor (21) and the underside of the main stack carrier (3) is connected to the first weighing device (22) for accepting a new stack (4).

If the sheet feeder (1) is operated with the auxiliary stack carrier (12), the speed of the main stack carrier (3) is adapted to that of the auxiliary stack carrier (12) upon approach of the main stack (4) to the auxiliary stack carrier (12) carrying the auxiliary stack (13). Subsequently, the auxiliary stack carrier (12) is guided out of the stack room and the auxiliary stack (13) is combined with the main stack (4). As the auxiliary stack (13) is combined with the main stack (4), the stack weight resting on the main stack carrier (3) is increased by the weight of the auxiliary stack (13).

In order to avoid overloading the driving mechanism (8) and the conveying system (6) when the auxiliary stack carrier (12) is utilized, a permissible auxiliary total weight is stored in the regulating and control device (19). Where the auxiliary stack carrier (12) is not utilized, this permissible auxiliary total weight is smaller than the permissible total weight by the maximum allowable weight of the auxiliary stack (13). Depending on the type of operation desired, e.g., with or without the auxiliary stack carrier (12), the permissible total weight or the permissible auxiliary total weight is stored as a nominal quantity in the regulating and control device (19).

It is also possible to determine the auxiliary stack weight in the following way. The height of the main stack (4) is determined in the regulating and controlling device (4) by switching from the lifting speed (rapid traverse) of the main stack carrier (3) to the speed (working speed) of the auxiliary stack carrier (12). The weight of the auxiliary stack (13) can be determined in the regulating and controlling device (19) from the height and weight of the main stack (4), as well as from the height of the auxiliary stack (13) which is stored in the regulating and controlling device (19) as the position of the auxiliary stack carrier (12) during the taking of the auxiliary stack (13). It is also conceivable to assign a device to determine the weight of the auxiliary stack, to the auxiliary conveying systems (17) or the auxiliary stack carrier (12). The values, generated by this device, are supplied to the regulating and controlling device (19).

Instead of the first weighing device (22), it is also possible to provide a second weighing device (28) in the sheet feeder (1). Each driving wheel (11) is in operative connection with a tension element (7). Two of the tension elements (7) are taken directly and two tension elements (7) are taken by way of deflector rolls (29) to the driving wheels (11). Of course, it is also possible to guide each tension element over a deflector roll (29). The deflector rolls (29) are carried in bearings (30), which are connected to the second weighing device (28) interposed with the frame (2). The second weighing device (28) may be constructed as a functional unit and connected to a regulating and controlling device (19), controlling the sheet feeder (1). It is also possible to assign a second weighing device (28) to each bearing (30) and to connect this with the regulating and controlling device (19).

During the operation of the sheet feeder (1), the main stack carrier (3) is brought into a position for taking a stack (4). After that, the stack (4) may be positioned on the main stack carrier (3) and the main stack carrier (3) may be raised. For this purpose, the driving mechanism (8) is activated by the regulating and controlling device (19). Before the main stack carrier (3) is raised, a signal, corresponding to the weight of the stack (4), is generated by the second weighing device (28) and supplied to the regulating and controlling device (19). Where the second weighing device (28) is calibrated to disregard the weight of the main stack carrier (3), this signal, reflecting the actual value recorded by the regulating and controlling device (19), corresponds to the weight of the stack (4). The weight of the stack (4) is compared to a nominal value stored in the regulating and controlling device (19), which characterizes a permissible maximum total weight. If the actual value is smaller than the nominal value, the main stack carrier (3) and the stack (4) is raised in rapid traverse. If the actual value is larger than the nominal value, i.e., if the weight of a stack (4) in the main stack carrier (3) is greater than the permissible maximum total weight, the driving mechanism (8) is prevented from starting by the regulating and controlling device (19).

If the sheet feeder (1) is operated without the auxiliary stack carrier (12), the approach of the top side of the stack (4) to the separating and conveying device (18) is followed by a switching over of the driving mechanism (8) to a creeping speed and to the feeding of the stack (4) to such an extent, that sheet-shaped material (5) can be separated and discharged by the separating and conveying device (18). After the stack (4) is processed, the main stack carrier (3) is returned to its position for taking a new stack (4). The weight of the stack (4) deposited on the main stack carrier (3) cannot be more than the permissible total weight stored in the regulating and controlling device (19).

If the sheet feeder (1) is operated with the auxiliary stack carrier (12), the speed of the main stack carrier (3) is adapted to that of the auxiliary stack carrier (12) as the stack (4) approaches the auxiliary stack carrier (12) carrying the auxiliary stack (13). Subsequently, the auxiliary stack carrier (12) is conveyed out of the stack room and the combining of the auxiliary stack (13) with the stack (4) is accomplished. By combining the auxiliary stack (13) with the main stack (4), the stack weight resting on the main stack carrier (3) is increased by the weight of the auxiliary stack (13).

In order to avoid overloading, the weight of the main stack (4) is determined in the operating state with the auxiliary stack carrier (12) and stored in the regulating and controlling device (19) if the stack weight is less than the permissible maximum total weight. The height of the stack (4) is determined in the regulating and controlling device by switching over the lifting speed (rapid traverse) of the main stack carrier (3) to the speed (working speed) of the auxiliary stack carrier (12). The weight of the auxiliary stack (13) can be determined in the regulating and controlling device (19) from the height and the weight of the stack (4), as well as the height of the auxiliary stack (13), which is stored in the regulating and controlling device (19) as the position of the auxiliary stack carrier (12) during the takeover of the auxiliary stack (13). In order to avoid exceeding the permissible maximum total weight by combining the auxiliary stack (13) with the main stack (4) in the operating state with the auxiliary stack carrier (12), the difference between the permissible total weight and the auxiliary stack weight is calculated and stored as a nominal (permissible auxiliary total) weight in the regulating and controlling device (19). After a stack (4) is positioned on the main stack carrier (3), the stack weight is determined by means of the second weighing device (28) and the measured value is supplied as actual value to the regulating and controlling device (19). In the regulating and controlling device, the actual weight is compared with the nominal value, determined as the difference between the permissible total weight and the weight of the auxiliary stack. If the weight of the stack is less than the difference between the permissible total weight and the auxiliary weight of the stack, the driving mechanism (8) is activated and the stack (4) is raised. If the weight of the stack is greater than the difference between the permissible total weight and the weight of the auxiliary stack, the driving mechanism (8) is not activated.

In a preferred embodiment incorporating a second weighing device, the second weighing device (28) is shown as a functional unit (FIG. 2). Alternatively, the second weighing device (28) may consists of measuring devices (31) associated with each bearing (30). In that case, the actual value representing the stack weight is determined by the regulating and controlling device (19) and may be compared with the nominal value.

What is claimed is:

1. A machine which processes sheet-shaped material, having an apparatus comprised of a weighing device, a regulating and controlling device, a driving mechanism, a conveying system, a stack carrier, and a separating and conveying device;

wherein said regulating and controlling device is connected to both said weighing device and said driving mechanism, with said driving mechanism further connected to said conveying system, and said conveying system operationally connected to said stack carrier; and wherein at least one permissible weight is stored in said regulating and controlling device and said regulating and controlling device compares said stored permissible weight to the weight of the stack determined by said weighing device and activates said driving mechanism only if said weight of the stack does not exceed said stored permissible weight, and can either lift said stack carrier from a stack-taking position after said stack carrier has taken a stack of sheet-shaped material or can lower said stack carrier after the singulating and discharging of the sheet-shaped material by said separating and conveying device; and wherein said apparatus further comprises an auxiliary stack carrier, wherein if said weight of the stack does not exceed said stored permissible weight, said driving mechanism can lower said stack carrier after the transfer of said stack to said auxiliary stack carrier.

2. The machine of claim 1, wherein a permissible auxiliary total weight, a permissible total weight less an auxiliary stack weight carried by said auxiliary stack carrier, is stored in said regulating and controlling device.

3. The machine of claim 1, wherein a permissible auxiliary total weight, stored as a nominal weight, will cause said regulating and controlling device to activate said driving mechanism, which will in turn operate said auxiliary stack carrier.

4. The machine of claim 3, wherein said permissible auxiliary total weight can compulsorily be realized as a nominal value responsible for the operation of said apparatus with said auxiliary stack carrier.

5. The machine of claim 1, wherein said auxiliary stack carrier contains a device which detects the weight of the auxiliary stack.

6. The machine of claim 1, wherein an auxiliary conveying system associated with said auxiliary stack carrier contains a device which detects the weight of an auxiliary stack.

7. A machine which processes sheet-shaped material, having an apparatus comprised of a weighing device, a regulating and controlling device, a driving mechanism, a conveying system, a stack carrier, and a separating and conveying device;

wherein said regulating and controlling device is connected to both said weighing device and said driving mechanism, with said driving mechanism further connected to said conveying system, and said conveying system operationally connected to said stack carrier; and wherein at least one permissible weight is stored in said regulating and controlling device and said regulating and controlling device compares said stored permissible weight to the weight of the stack determined by said weighing device and activates said driving mechanism only if said weight of the stack does not exceed said stored permissible weight, and can either lift said stack carrier from a stack-taking position after said stack carrier has taken a stack of sheet-shaped material or can lower said stack carrier after the singulating and discharging of the sheet-shaped material by said separating and conveying device; and wherein a second weighing device is associated with said conveying system.

8. The machine of claim 7, wherein said conveying system comprises tension elements and said second weighing device is associated with at least one of said tension elements.

9. The machine of claim 8, wherein said conveying system comprises four tension elements and said second weighing device is associated with at least one of the four tension elements.

10. The machine of claim 8, wherein said conveying system comprises at least two tension elements, which are guided over deflector rolls positioned in a frame of said sheet feeder, and said second weighing device is associated with at least one deflector roll.

11. The machine of claim 8, wherein said second weighing device comprises at least one measuring device.

12. A machine which processes sheet-shaped material, having an apparatus comprised of a weighing device, a regulating and controlling device, a driving mechanism, a conveying system, a stack carrier, and a separating and conveying device;

wherein said regulating and controlling device is connected to both said weighing device and said driving mechanism, with said driving mechanism further connected to said conveying system, and said conveying system operationally connected to said stack carrier; and wherein at least one permissible weight is stored in said regulating and controlling device and said regulating and controlling device compares said stored permissible weight to the weight of the stack determined by said weighing device and activates said driving mechanism only if said weight of the stack does not exceed said stored permissible weight, and can either lift said stack carrier from a stack-taking position after said stack carrier has taken a stack of sheet-shaped material or can lower said stack carrier after the singulating and discharging of the sheet-shaped material by said separating and conveying device; and wherein the top side of said stack carrier is at floor level when said stack carrier is in the position to take another stack.

13. The machine of claim 12, wherein said stack carrier rests with its underside on said first weighing device when said stack carrier is in the position to take another stack.

14. A machine which processes sheet-shaped material, having an apparatus comprised of a weighing device, a regulating and controlling device, a driving mechanism, a conveying system, a stack carrier adapted to receive a preassembled stack from a stack-taking position, and a separating and conveying device;

wherein said regulating and controlling device is connected to both said weighing device and said driving mechanism, with said driving mechanism further connected to said conveying system, and said conveying system operationally connected to said stack carrier; and wherein at least one permissible weight is stored said regulating and controlling device and said regulating and controlling device compares said stored permissible weight to the weight of the stack determined by said weighing device and activates said driving mechanism only if said weight of the stack does not exceed said stored permissible weight, and can either lift said stack carrier from a stack-taking position after said stack carrier has taken a stack of sheet-shaped material or can lower said stack carrier after the singulating and discharging of the sheet-shaped material by said separating and conveying device;

wherein a first weighing device is associated with said stack carrier; and wherein two measured value transducers for detecting the weight of said stack are positioned diagonally opposite to one another in said first weighing device.

15. A machine which processes sheet-shaped material, having an apparatus comprised of a weighing device, a regulating and controlling device, a driving mechanism, a conveying system, a stack carrier adapted to receive a preassembled stack from a stack-taking position, and a separating and conveying device;

wherein said regulating and controlling device is connected to both said weighing device and said driving mechanism, with said driving mechanism further connected to said conveying system, and said conveying system operationally connected to said stack carrier; and wherein at least one permissible weight is stored in said regulating and controlling device and said regulating and controlling device compares said stored permissible weight to the weight of the stack determined by said weighing device and activates said driving mechanism only if said weight of the stack does not exceed said stored permissible weight, and can either lift said stack carrier from a stack-taking position after said stack carrier has taken a stack of sheet-shaped material or can lower said stack carrier after the singulating and discharging of the sheet-shaped material by said separating and conveying device;

wherein a first weighing device is associated with said stack carrier; and wherein said first weighing device is formed from a stationary lower frame and an upper frame, wherein said upper frame can be shifted in a vertical direction, is associated with the lower frame and is supported at four stops, two of which are constructed as measured value transducers.

* * * * *